US010864417B1

(12) United States Patent
Park

(10) Patent No.: US 10,864,417 B1
(45) Date of Patent: Dec. 15, 2020

(54) BALL SUPPLY INTEGRATED TYPE AUTO TEE-UP MACHINE WITH SIMPLE STRUCTURE

(71) Applicant: JOEN PRECISION CO., LTD, Daejeon (KR)

(72) Inventor: Jae Sung Park, Daejeon (KR)

(73) Assignee: JOEN PRECISION CO., LTD., Daejeon (KR)

( * ) Notice: Subject to any disclaimer, the term of this patent is extended or adjusted under 35 U.S.C. 154(b) by 0 days.

(21) Appl. No.: 16/824,405

(22) Filed: Mar. 19, 2020

(30) Foreign Application Priority Data

Oct. 1, 2019 (KR) ..... 10-2019-0121287

(51) Int. Cl.
*A63B 57/00* (2015.01)

(52) U.S. Cl.
CPC ..... *A63B 57/0006* (2013.01)

(58) Field of Classification Search
CPC ..... A63B 47/002; A63B 57/0006
USPC ..... 473/132–137
See application file for complete search history.

(56) References Cited

U.S. PATENT DOCUMENTS 5,348,305 A * 9/1994 Lowe ..... A63B 57/0006 473/133
5,603,664 A * 2/1997 Provost ..... A63B 57/0006 473/134
5,611,737 A * 3/1997 Rau ..... A63B 57/0006 473/133
6,984,178 B1 * 1/2006 Chen ..... A63B 57/0006 473/136
2005/0233818 A1 * 10/2005 Chen ..... A63B 47/002 473/135

FOREIGN PATENT DOCUMENTS

KR 100942030 B1 * 2/2010
KR 101924480 B1 12/2018

* cited by examiner

*Primary Examiner* — Steven B Wong
(74) *Attorney, Agent, or Firm* — Rabin & Berdo, P.C.

(57) ABSTRACT

Provided is a ball supply integrated type auto tee-up machine with a simple structure, and more particularly, to an advanced concept technology for easily improving a structure of an auto tee-up machine while performing complexly a function of supplying a golf ball to a golf tee and a function of teeing-up the golf ball on the golf tee by using a single motor. The present invention provides a technique to implement a function of allowing a second ball chute to supply a golf ball to a golf tee and a function of teeing-up the golf ball placed on the golf tee with one-stop automation after delivering the golf ball inserted to a first ball chute to the second ball chute while the golf tee and the first ball chute ascend/descend and the second ball chute descends/ascends in an opposite direction at the same time by using a single tee-up motor.

8 Claims, 11 Drawing Sheets

BALL SUPPLY INTEGRATED TYPE AUTO TEE-UP MACHINE WITH SIMPLE STRUCTURE

TECHNICAL FIELD

The present invention relates to an advanced concept technology for easily improving a structure of an auto tee-up machine while performing complexly a function of supplying a golf ball to a golf tee and a function of teeing-up the golf ball placed on the golf tee by using a single motor.

BACKGROUND ART

In recent years, golf has been spotlighted as a popular sport, and its population is growing rapidly. In response to this trend, recently, construction of indoor and outdoor golf practice ranges with advanced automation facilities for providing convenience to users has been spread.

A golfer at the golf practice range corrects his swing form while practicing his striking, and makes a lot of efforts and repeated practices to swing the ball to a desired position.

In addition, a 'screen golf', a golf simulation system that can achieve a visual effect such as playing golf at an outdoor golf course and enjoy a golf game with a companion, is widely distributed on the market.

In such golf practice range and screen golf, a golf ball tee-up device is required to place the golf ball on a tee provided on an artificial mat.

The tee-up device which is widely used in the related art is exposed and provided to each of swing boxes at the golf practice range and the screen golf to perform a role of automatically teeing-up a golf ball, and generally, when the golfer steps on a foot pedal provided at a swing box, balls stored in a ball storage supply device are discharged one by one to be supplied to the golfer.

However, since the conventional golf ball tee-up device configured as described above is constituted by a structure that the golfer may receive the ball by stepping on the foot pedal continuously, the golfer focuses much attention on its operation, and as the tee-up device is placed adjacent to the tee provided at the swing box, psychological anxiety of the golfer is caused to cause a trouble in hitting the ball correctly, and the tee-up device is frequently damaged by hitting the tee-up device due to a mistake.

In recent years, in order to solve the above problems, an embedded type tee-up device that gives the golfer a sense of security by embedding a golf ball tee-up device under the ground of the swing box to block exposure to outdoor elements has gained great response.

As a prior art related to such an embedded type tee-up device, there is disclosed "U.S. Pat. No. 1,924,480, Title/Ball supply device integrated type auto tee-up machine", which is a pre-registered invention of the present applicant.

The prior art was that a detachable ball supply device is integrally assembled on one side of the auto tee-up machine to not only smoothly supply the collected golf balls directly to the auto tee-up machine, but also automatically tee up the golf balls placed on the tee.

DISCLOSURE

Technical Problem

These prior arts cause problems that since two expensive ball supply motors and tee-up motors are used to implement functions of supplying golf balls to a golf tee and teeing-up the golf balls, a lot of components are required and thus manufacturing costs are high, an overall volume is large and thus a lot of installation spaces are required, and the structure is very complicated and thus the manufacturing is difficult and productivity is deteriorated.

Technical Solution

As a means for solving these problems, the present invention provides a technique to implement a function of allowing a second ball chute to supply a golf ball to a golf tee and a function of teeing-up the golf ball placed on the golf tee after delivering the golf ball inserted to a first ball chute adjacent to and below the second ball chute while the golf tee and the first ball chute ascend/descend and the second ball chute descends/ascends in an opposite direction at the same time by using a single tee-up motor with one-stop automation.

Further, the present invention provides a technique to block the insertion of golf balls during ascending/descending of a first ball chute and insert the golf balls only when the first ball chute is located at a lowest point by using a tensionable leaf spring or a stopper device when collected golf balls are inserted to the first ball chute through a slope.

Advantageous Effects

According to the present invention, the present invention is configured to exhibit complexly functions of supplying a golf ball to a golf tee and teeing-up the golf ball placed on the golf tee by using a single tee-up motor to reduce the components of the auto tee-up machine, and as a result, the structure is simplified to facilitate the manufacturing and improve productivity, and the manufacturing costs are greatly reduced to improve price competitiveness.

Further, even if the configuration for supplying the golf ball is integrally provided, the volume of the auto tee-up machine is small so that the installation space is small and the space utilization is excellent, and it is possible to smoothly supply the golf ball to the golf tee while making the structure of the auto tee-up machine more compact.

Further, the tensionable leaf spring or the stopper device is used to insert the golf ball only when the first ball chute is located at the lowest point while blocking the insertion of the golf ball during ascending/descending of the first ball chute provided in the case of the tee-up machine, thereby preventing a malfunction due to fitting of the golf ball during the ascending/descending of the first ball chute and ensuring the certainty of the operation of the auto tee-up machine.

MODES OF THE INVENTION

Figure 1:
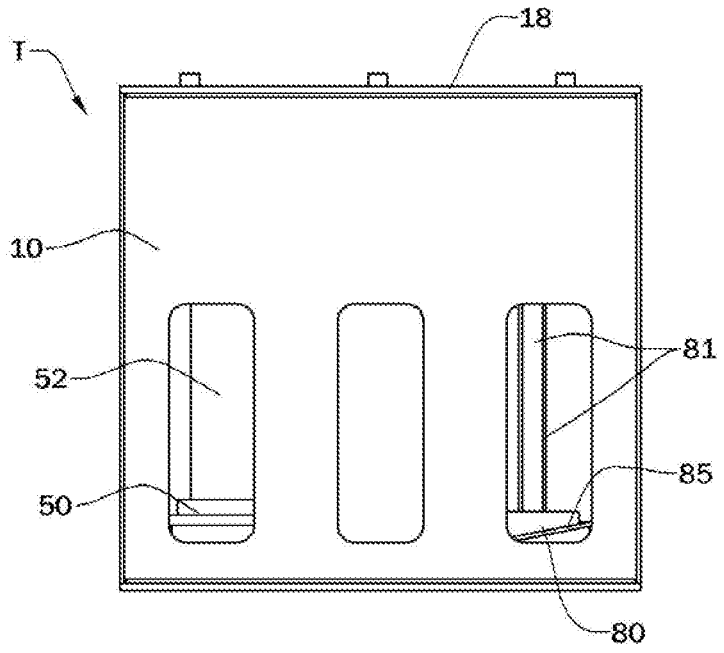
FIG. 1 is a front view of an auto tee-up machine to which the present invention is applied.
Figure 2:
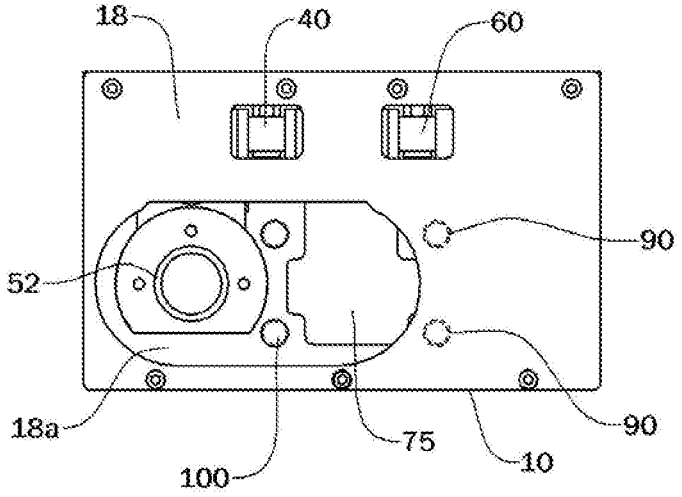
FIG. 2 is a plan view of the auto tee-up machine of the present invention.

Preferred embodiments for more specifically implementing the solution of the problem to be solved by the present invention will be described.

When schematically describing an overall configuration according to a preferred embodiment of the present invention by the accompanying drawings, an overall configuration is largely divided into components of a case 10, a tee-up motor 20, a driving belt 30, a first driven belt 40, a tee lift 50, a second driven belt 60, a second lifting body 70, a second ball chute 75, a first lifting body 80, a first ball chute 85, a pair of one-stage ball supports 90, and a pair of two-stage ball supports 100.

Hereinafter, the present invention made of the schematic configuration will be described in more detail to be easily implemented.

The case 10 of the present invention is formed of a housing having an opened upper portion, and a ball inlet 12 that may insert a golf ball 1 thereinto is opened and formed at a side plate 11.

A motor mounting plate 22 is connected and provided on a rear surface of the case 10 by using a plurality of connecting rods 21, a tee-up motor 20 that is a power source of an auto tee-up machine T is provided on the motor mounting plate 22, and the tee-up motor 20 may be used as a power source that performs a function of automatically supplying the golf ball 1 to a golf tee 52 as well as a function of teeing-up the golf ball while the golf tee 52 ascends/descends even though one tee-up motor is used.

A bearing 14 is inserted and formed into a lower side of the tee-up motor 20 through a rear plate 13 of the case 10, a driving shaft 15 is rotatably provided to be exposed to the inside and the outside of the case 10 through the bearing 14, and the driving belt 30 is connected to a belt pulley 16 coupled to one side of the driving shaft 15 which is exposed to the outside and a belt pulley 16 coupled to a motor shaft 20*a* of the tee-up motor 20, so that the driving shaft 15 may selectively rotate forward/backward according to the operation of the tee-up motor 20.

In addition, a first roller shaft 41 is provided through an upper side of the rear plate 13 on the same vertical line as the driving shaft 15, and the first driven belt 40 is connected between a plurality of rollers 42 fitted to the outside of the first roller shaft 41 and a belt pulley 16 coupled to the other side of the driving shaft 15 exposed to the inside of the case 10.

A pair of guide rods 51 is vertically provided between the other side plate 11*a* of the case 10 and the first driven belt 40 at front and rear intervals and the tee lift 50 is provided while passing through the guide rods 51, so that the tee lift 50 may freely ascend/descend along the guide rods 51, and one side of the tee lift 50 is integrally coupled to a lower side of the first driven belt 40, while the golf tee 52 on which the golf ball 1 is placed is fixed to the upper portion of the tee lift 50.

In addition, a second roller shaft 61 and a driven shaft 63 are provided by passing through upper and lower sides of the rear plate 13 at a distance from the first driven belt 40, respectively, and the second driven belt 60 is connected between a plurality of rollers 62 fitted to the second roller shaft 61 and a belt pulley 66 coupled to the driven shaft 63.

Here, it is more preferred that the driving belt 30, the first driven belt 40, and the second driven belt 60 of the present invention are applied with timing belts with low noise and excellent power transmission, and all the belt pulleys 16 and 66 are applied with timing pulleys so that the timing belts may be connected.

A pair of guide rods 71 is vertically provided between the first driven belt 40 and the second driven belt 60 at front and rear intervals and the second lifting body 70 is provided while passing through the guide rods 71, so that the second lifting body 70 may freely ascend/descend along the guide rods 71, and both sides of the second lifting body 70 are integrally coupled to upper sides of the first driven belt 40 and the second driven belt 60, respectively.

The second ball chute 75 inclined downward in a direction in which the golf tee 52 is provided is provided on the front surface of the second lifting body 70, and the second ball chute 75 serves to lift the golf ball 1 and slide the lifted golf ball 1 to the golf tee 52.

A pair of guide rods 81 is vertically provided between one side plate 11 of the case 10 and the second driven belt 60 at front and rear intervals and the first lifting body 80 is provided while passing through the guide rods 81, so that the first lifting body 80 may freely ascend/descend along the guide rods 81, and one side of the first lifting body 80 is integrally coupled to a lower side of the second driven belt 60.

The first ball chute 85 inclined downward in a direction in which the golf tee 52 is provided is provided on the front surface of the first lifting body 80, and the first ball chute 85 serves to lift the golf ball 1 and slide the lifted golf ball 1 toward the second ball chute 75.

As such, the tee lift 50, the first driven belt 40, the second lifting body 70, the second driven belt 60, and the first lifting body 80 of the present invention are maintained to be indirectly integrated with each other so as to interlock with each other without a separate power source when the driving shaft 15 rotates forward/backward according to the operation of the tee-up motor 20.

That is, when the driving shaft 15 rotates forward, the first driven belt 40 rotates forward, while the second driven belt 60 rotates backward, so that the golf tee 52 provided on the tee lift 50 and the first ball chute 85 attached to the first lifting body 80 ascend and at the same time, the second ball chute 75 attached to the second lifting body 70 descends in reverse in conjugation with this. In addition, while the golf tee 52 ascends, when the driving shaft 15 rotates backward, the first driven belt 40 rotates backward, while the second driven belt 60 rotates forward, so that the golf tee 52 and the first ball chute 85 descend, and at the same time, the second ball chute 75 may ascend in reverse in conjugation with this.

Between the first ball chute 85 and the second ball chute 75, a pair of one-stage ball supports 90 is vertically provided at front and rear intervals to not only guide the upward movement of the golf ball 1, but also support the golf ball 1 passing over the second ball chute 75 together with a pair of two-stage ball supports 100.

Figure 3:
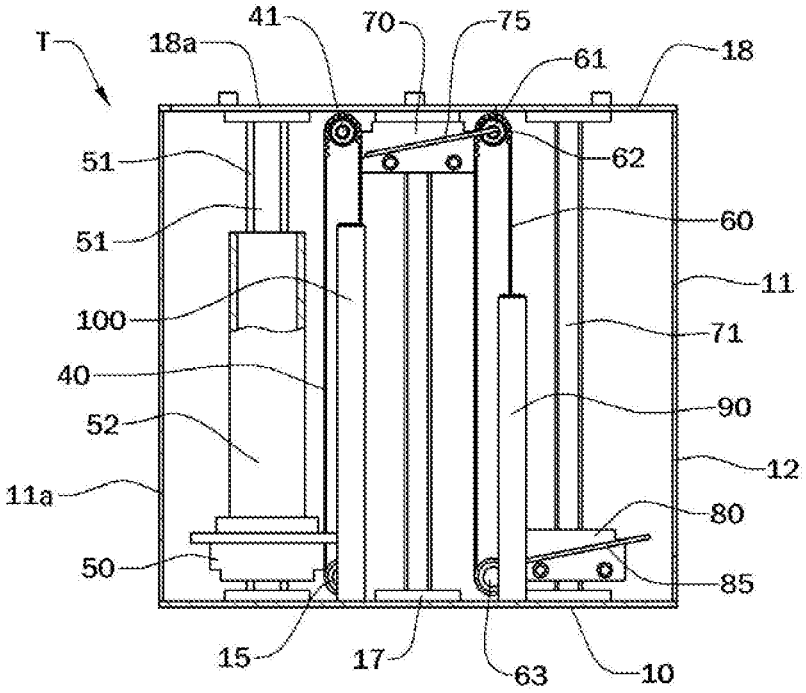
FIG. 3 is a front cross-sectional view of the auto tee-up machine of the present invention.
Figure 4:
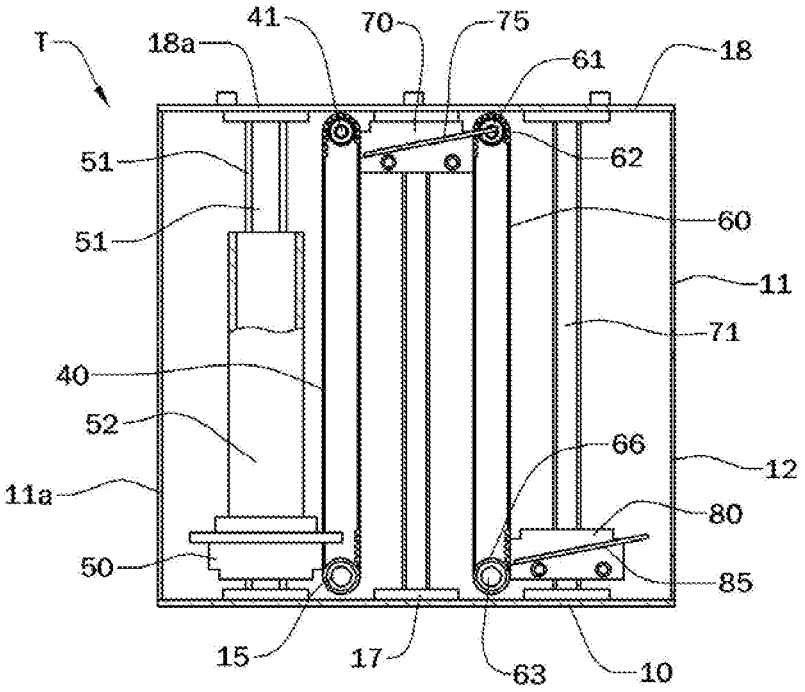
FIG. 4 is a front cross-sectional view of a connection state of a tee lift, a first driven belt, a second lifting body, a second driven belt, and a first lifting body of the present invention.
Figure 5:
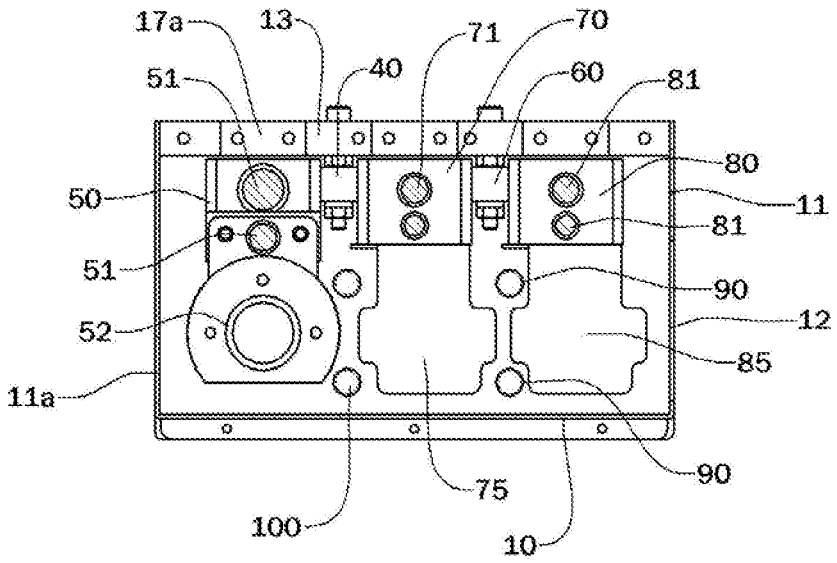
FIG. 5 is a plan cross-sectional view of the auto tee-up machine of the present invention.

Further, between the second ball chute 75 and the tee lift 50, a pair of two-stage ball supports 100 is vertically provided at front and rear intervals to not only guide the upward movement of the golf ball 1, but also support the golf ball 1 passing over the second ball chute 75 together with a pair of one-stage ball supports 90. In particular, the pair of two-stage ball supports 100 is not only provided at a height higher than that of the one-stage ball supports 90 as illustrated in FIG. 3, but also formed at a height at least equal to or higher than that of the golf tee 52, so that the golf ball 1 passed through the upper portion of the pair of two-stage ball supports 100 may be smoothly seated on an upper end of the golf tee 52.

Figure 6:
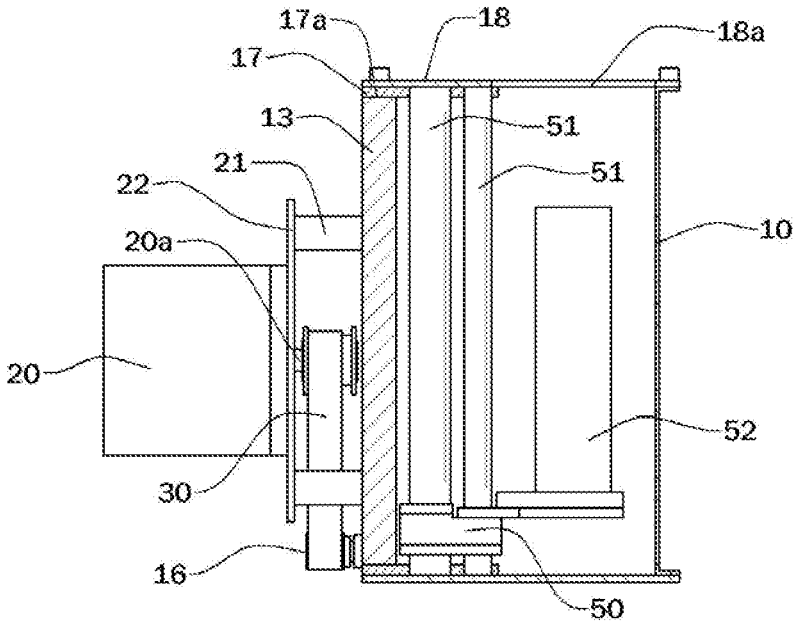
FIG. 6 is a lateral cross-sectional view of the auto tee-up machine of the present invention.
Figure 7:
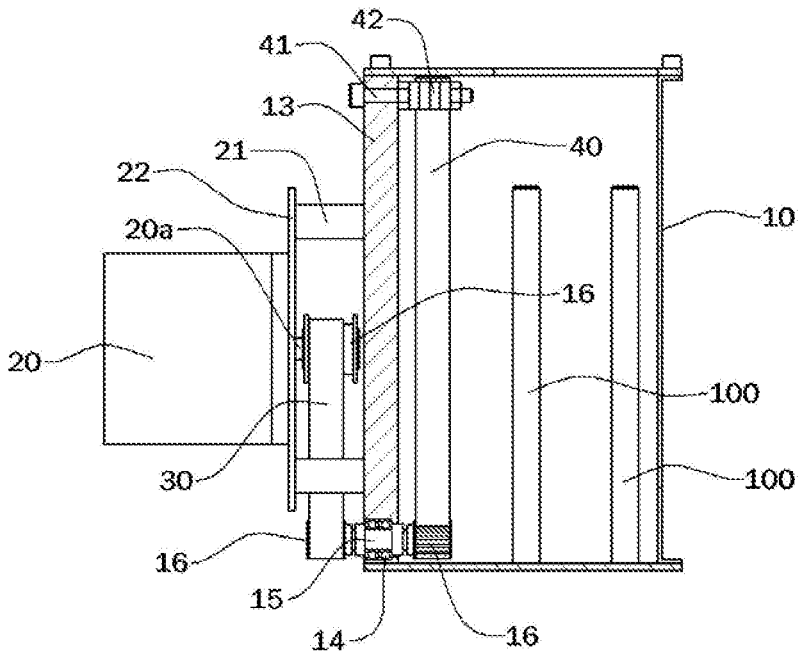
FIG. 7 is a lateral cross-sectional view of a connection state of a tee-up motor, a driving belt, a driving shaft, and a first driven belt of the present invention.

On the other hand, considering that the guide rods 51, 71, and 81 need to be maintained in a solid vertical state without movement so that the tee lift 50, the first lifting body 80, and the second lifting body 70 smoothly ascend/descend, the guide rods 51, 71, and 81 are vertically provided through fixing brackets 17 fitted to bracket grooves 17*a* recessed at upper and lower ends of the rear plate 13, respectively, as illustrated in FIG. 6, so as to more smoothly guide the tee lift 50, the first lifting body 80, and the second lifting body 70. Furthermore, the guide rods 51 for guiding the tee lift 50 among the guide rods 51, 71, and 81 are formed to have a larger diameter than those of other guide rods 71 and 81 to maintain stiffness that can sufficiently withstand a shock generated when the golf tee 52 is hit.

In the case 10, an upper portion may be opened, but an upper cover 18 may be additionally provided at the upper end. At this time, ball exposure holes 18*a* need to be formed in one side of the upper cover 18 so as to expose the golf tee 52 and the golf ball 1.

A ball supply and tee-up operation by an auto tee-up machine T of the present invention having such a configuration to be implemented with one-stop automation will be described in detail.

Figure 8:
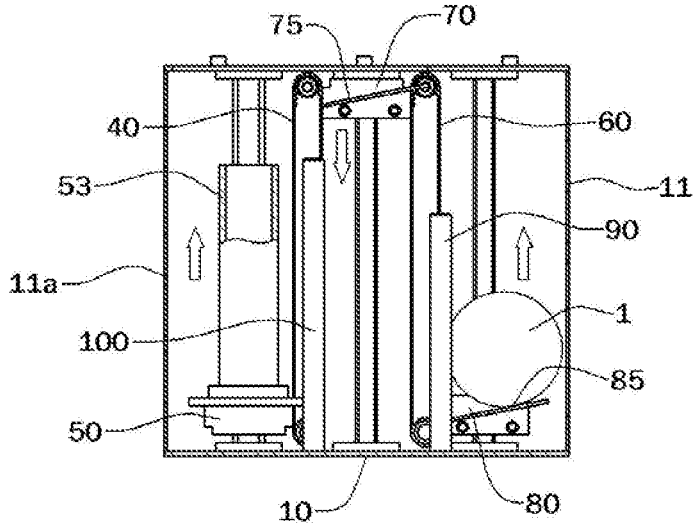
FIGS. 8 to 13 are front cross-sectional views sequentially illustrating automatic supplying and tee-up operating states of golf balls according to the present invention.
Figure 9:
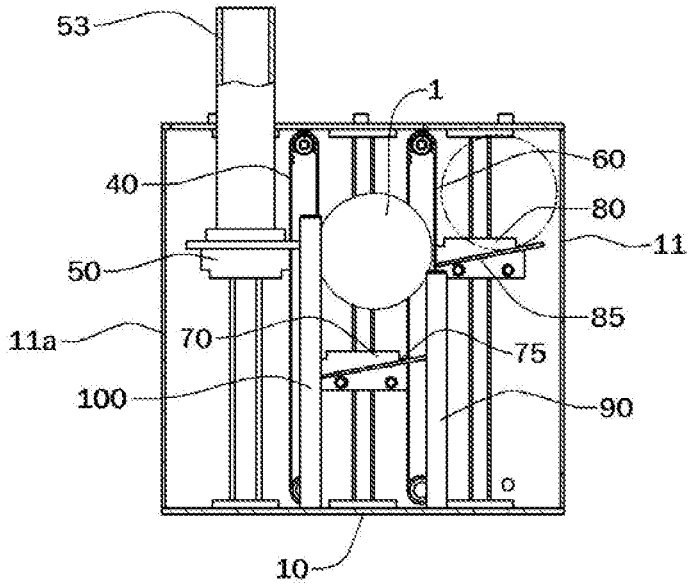
Figure 10:
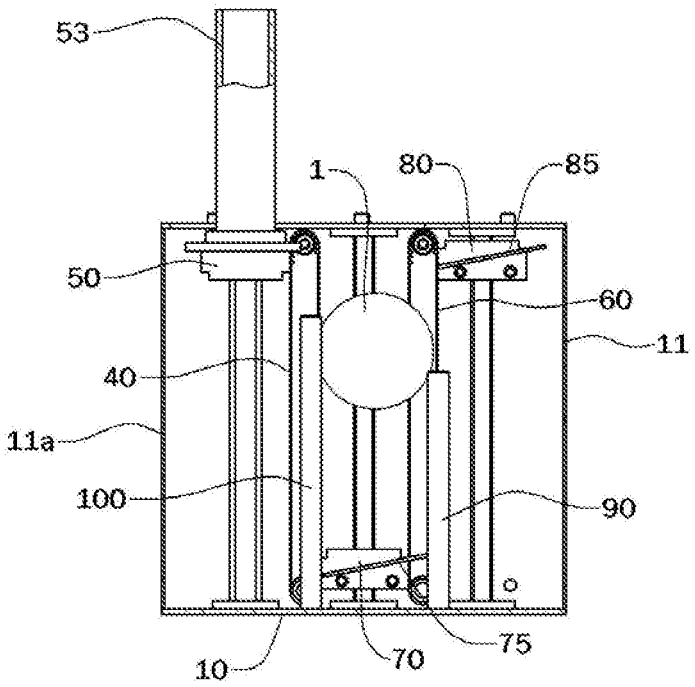

First, when the golf ball 1 is inserted and seated in the first ball chute 85 as illustrated in FIG. 8, while the first ball chute 85 and the golf tee 52 ascend according to the operation of the tee-up motor 20 and the second ball chute 75 descends at the same time, the golf ball 1 seated on the first ball chute 85 is guided to the one-stage ball support 90 and ascends, and then passes through the upper portion of the one-stage ball support 90 to reach between the one-stage ball support 90 and the two-stage ball support 100 as illustrated in FIG. 9.

Figure 11:
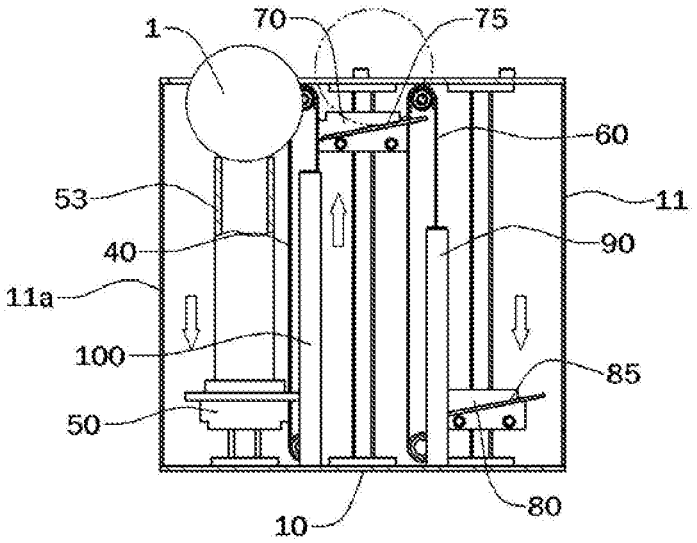
Figure 12:
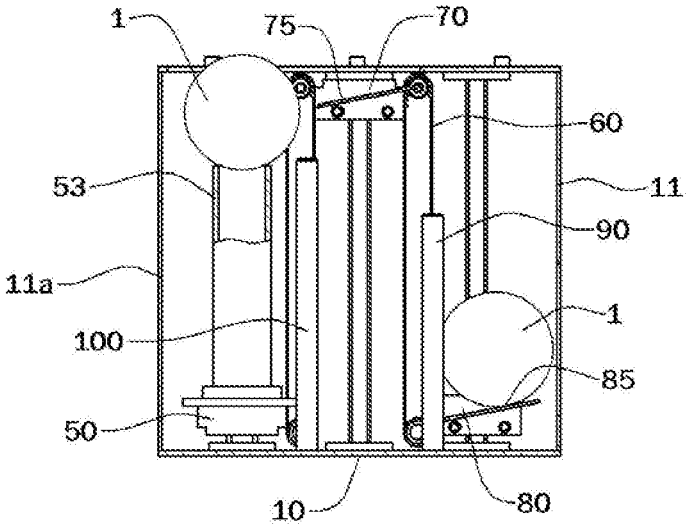

Sequentially, as illustrated in FIG. 11, while the first ball chute 85 and the golf tee 52 descend and the second ball chute 75 ascends at the same time, the golf ball 1 reaching between the one-stage ball support 90 and the two-stage ball support 100 ascends while being guided to the two-stage ball support 100 by the ascending second ball chute 75 and then passes through the upper portion of the two-stage ball support 100 to be supplied to an upper end of the descending golf tee 52, and at the same time, the golf ball 1 is inserted and seated into the descending first ball chute 85.

Figure 13:
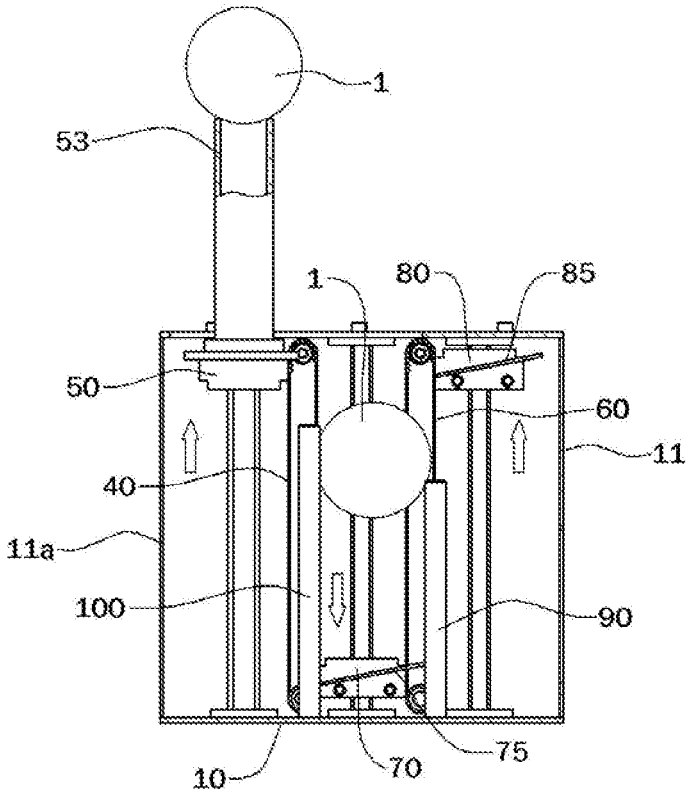

Sequentially, as illustrated in FIG. 13, while the first ball chute 85 and the golf tee 52 ascend and the second ball chute 75 descends at the same time, the golf ball 1 supplied to the golf tee 52 is teed-up and the golf ball 1 seated on the first ball chute 85 is guided to the one-stage ball support 90 and ascends, and then passes through the upper portion of the one-stage ball support 90 to reach between the one-stage ball support 90 and the two-stage ball support 100. As a result, when the teed-up golf tee 52 descends, the golf balls 1 are always supplied wholly to maintain a tee-up preparation state.

Therefore, the function of supplying the golf ball 1 to the golf tee 52 and the function of teeing-up the golf ball 1 are complexly implemented with one-stop automation by using a single tee-up motor 20 to greatly reduce the manufacturing cost. In addition, even if the configuration for supplying the golf ball 1 is provided integrally, the configuration provides a special effect that the overall volume of the auto tee-up machine T is small, and thus not only the installation space is small, but also space utilization is excellent, and the golf ball 1 may be smoothly supplied to the golf tee 52.

Figure 14:
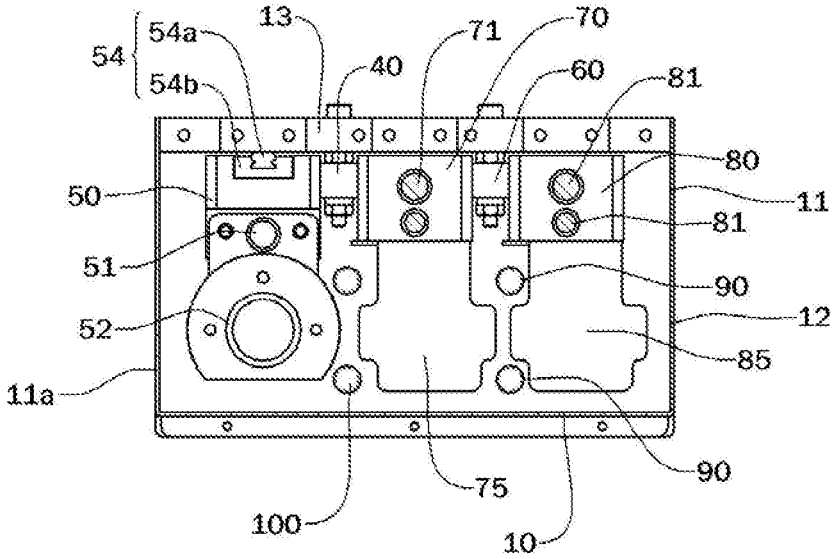
FIG. 14 is a plan cross-sectional view illustrating another embodiment of an auto tee-up machine to which an LM guide of the present invention is applied.
Figure 15:
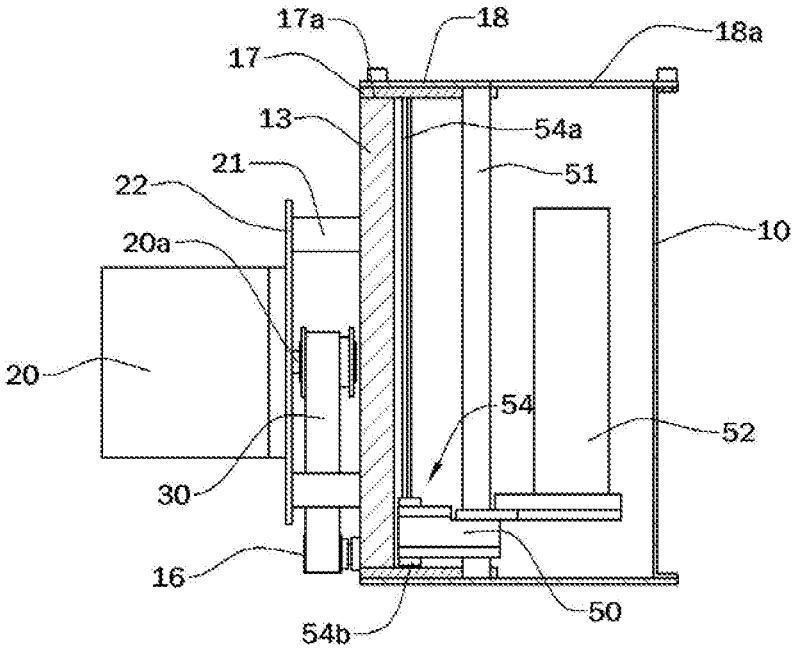
FIG. 15 is a lateral cross-sectional view illustrating another embodiment of the auto tee-up machine to which the LM guide of the present invention is applied.

In addition, in the auto tee-up machine T of the present invention, as illustrated in FIGS. 14 and 15, other configurations are the same as each other, but a configuration of guiding the ascending/descending of the tee lift 50 may be differently applied.

As a technical configuration for this purpose, a linear motion (LM) rail 54*a* constituting the LM guide 54 is attached to the rear plate 13 between the other side plate 11*a* of the case 10 and the first driven belt 40, an LM block 54*b* coupled to the LM rail 54*a* is attached to a rear surface of the tee lift 50, and the tee lift 50 is provided while passing through the guide rods 51 vertically provided in front of the LM guide 54. Accordingly, the tee lift 50 may freely ascend/descend along the LM rail 54*a* and the guide rods 51, one side of the tee lift 50 is integrally coupled to a lower side of the first driven belt 40, and the golf tee 52 on which the golf ball 1 is placed is fixed to the upper portion of the tee lift 50.

On the other hand, the present invention is further incorporated with a novel technique so as to stop the insertion of the golf ball 1 during the ascending/descending of the first ball chute 85 and insert the golf ball 1 only when the first ball chute 85 is located to a lowest point.

Figure 16:
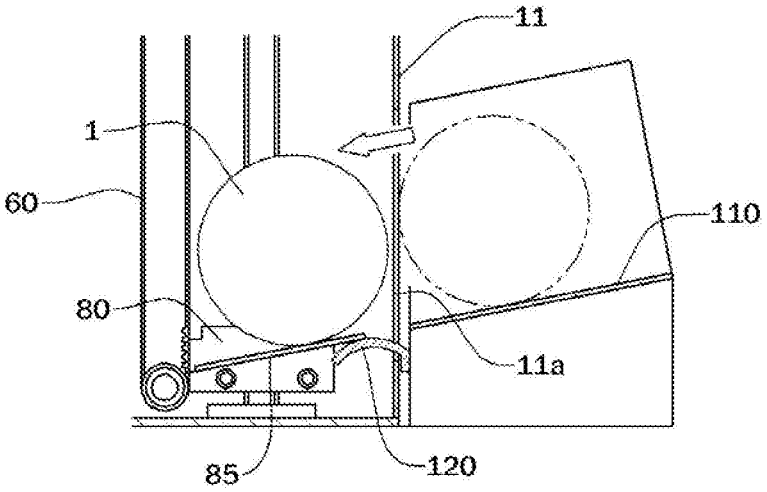
FIG. 16 is a front cross-sectional view illustrating an installation state of a slope and a leaf spring of the present invention.
Figure 17:
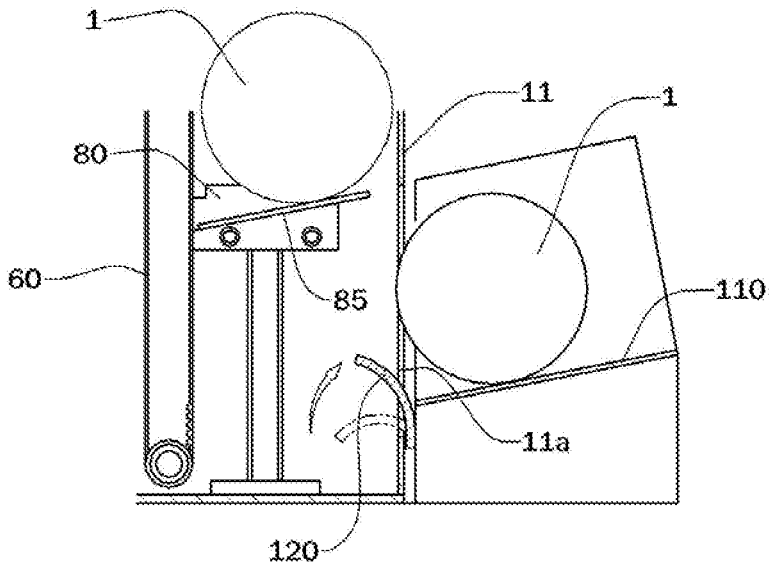
FIG. 17 is a front cross-sectional view illustrating a state in which the insertion of the golf ball is blocked by the leaf spring of the present invention.

As a technical configuration for this purpose, as illustrated in FIGS. 16 and 17, a slope 110 for supplying the collected golf balls 1 to the first ball chute 85 by natural gradient is provided adjacent to the ball inlet 12, and a tensionable leaf spring 120 is to provided at a lower end of the slope 110, and as a result, the leaf spring 120 opens the slope 110 while being pressed downward by the first ball chute 85 when the first ball chute 85 reaches a lowest point so as to insert the golf ball 1. On the other hand, the leaf spring 120 closes the slope 110 while being bent upward during the ascending/descending of the first ball chute 85 by an elastic restoring force so as to block the insertion of the golf ball 1, and as a result, it is possible to provide a special effect of preventing a malfunction that the golf ball 1 is fitted between one side plat 11 and the one-stage ball support 90 and ensuring the certainty of the operation of the auto tee-up machine T.

Figure 18:
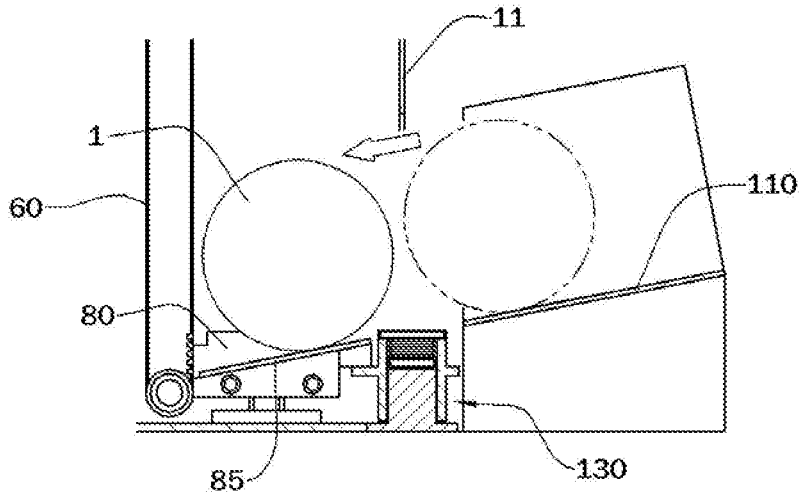
FIG. 18 is a front cross-sectional view illustrating an installation state of a slope and a stopper device of the present invention.
Figure 19:
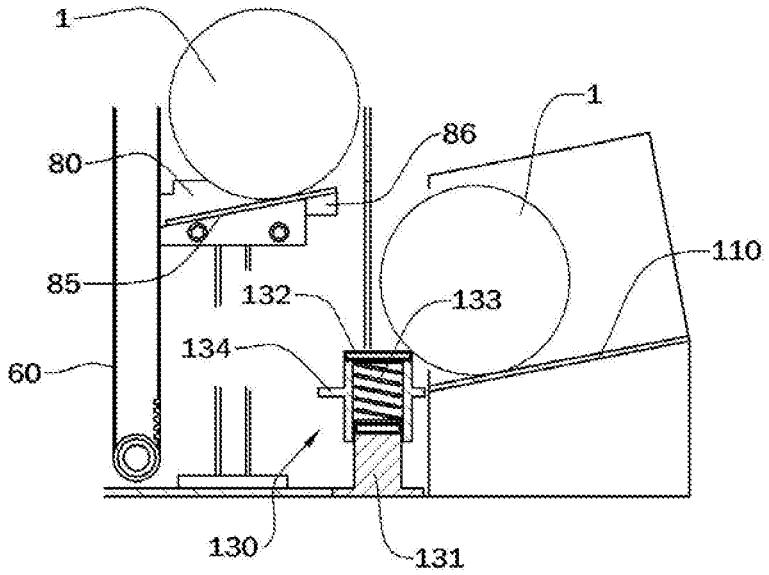
FIG. 19 is a front cross-sectional view illustrating a state in which the golf ball is blocked by the stopper device of the present invention.

In addition, in the present invention, as another method to stop the insertion of the golf ball 1 during the ascending/descending of the first ball chute 85 and insert the golf ball 1 only when the first ball chute 85 is located at the lowest point, as illustrated in FIGS. 18 and 19, the slope 110 for supplying the collected golf balls 1 to the first ball chute 85 by natural gradient is provided adjacent to the ball inlet 12 and a stopper device 130 is provided at the lower end of the slope 110 and the ball inlet 12.

Here, in the stopper device 130, a stopper guider 131 is provided to be fixed to the bottom thereof, a stopper 132 is fitted to the upper portion of the stopper guider 131 so as to be movable up and down, a compression spring 133 is provided elastically in the stopper 132, and a pressing protrusion 134 protrudes from an outer surface of the stopper 132.

Accordingly, when the first ball chute 85 reaches the lowest point, the stopper 132 opens the slope 110 while the pressing protrusion 134 protruding from the outer surface is pressed by a pusher 86 attached to the lower end of the first ball chute 85 so as to smoothly insert the golf ball 1 to the first ball chute 85. In addition, when the first ball chute 85 ascends/descends, the stopper 132 closes the slope 110 while moving upward by the elastic restoring force of the compression spring 133 so as to automatically block the insertion of the golf ball 1.

[Explanation of Reference Numerals and Symbols]

| | |
|---|---|
| T: Auto tee-up machine | 1: Golf ball |
| 10: Case | 11, 11a: Side plate |
| 12: Ball inlet | 13: Rear plate |
| 14: Bearing | 15: Driving shaft |
| 16, 66: Belt pulley | 17: Fixing bracket |
| 18: Upper cover | 18a: Ball exposure hole |
| 20: Tee-up motor | 22: Motor mounting plate |
| 30: Driving belt | 40: First driven belt |
| 41: First roller shaft | 42, 62: Roller |
| 50: Tee lift | 51, 71, 81: Guide rod |
| 52: Golf tee | 54: LM guide |
| 60: Second driven belt | 61: Second roller shaft |
| 63: Driven shaft | 70: Second lifting body |
| 75: Second ball chute | 80: First lifting body |
| 85: First ball chute | 90: One-stage ball support |
| 100: Two-stage ball support | 110: Slope |
| 120: Leaf spring | 130: Stopper device |
| 131: Stopper guider | 132: Stopper |
| 133: Compression spring | 134: Pressing protrusion |

What is claimed is:

1. A ball supply integrated type auto tee-up machine with a simple structure comprising:

a case (10) formed of a housing having an opened upper portion and having a ball inlet (12) formed at a side plate (11);

a tee-up motor (20) connected and provided to a rear surface of the case (10);

a driving belt (30) rotatably provided through a rear plate (13) below the case (10) and connected between one side of a driving shaft (15) and the tee-up motor (20);

a first driven belt (40) connected between another side of the driving shaft (15) and a first roller shaft (41) provided rotatably through an upper side of the rear plate (13);

a tee lift (50) provided to be able to ascend/descend over a pair of guide rods (51) provided vertically between another side plate (11*a*) of the case (10) and the first driven belt (40), having one side coupled integrally to a lower side of the first driven belt (40), and having a golf tee (52) provided at an upper portion thereof;

a second driven belt (60) connected between a second roller shaft (61) and a driven shaft (63) provided through upper and lower sides of the rear plate (13) at a distance from the first driven belt (40), respectively;

a second lifting body (70) provided to be able to ascend/descend over a pair of guide rods (71) provided between the first driven belt (40) and the second driven belt (60) and having sides coupled integrally to upper sides of the first driven belt (40) and the second driven belt (60), respectively;

a second ball chute (75) attached to a front surface of the second lifting body (70) and inclined downward toward the golf tee (52);

a first lifting body (80) provided to be able to ascend/descend over a pair of guide rods (81) provided between the side plate (11) of the case (10) and the second driven belt (60) and having one side coupled integrally to a lower side of the second driven belt (60);

a first ball chute (85) attached to a front surface of the first lifting body (80) and inclined downward toward the golf tee (52);

a pair of one-stage ball supports (90) provided between the first ball chute (85) and the second ball chute (75); and a pair of two-stage ball supports (100) provided between the second ball chute (75) and the tee lift (50) and provided at a height higher than a height of the one-stage ball supports (90).

2. The ball supply integrated type auto tee-up machine with the simple structure of claim 1, wherein when the driving shaft (15) rotates forward, the golf tee (52) and the first ball chute (85) ascend and the second ball chute (75) descends at a same time, and when the driving shaft (15) rotates backward while the golf tee (52) ascends, the golf tee (52) and the first ball chute (85) descend and the second ball chute (75) ascends at a same time.

3. The ball supply integrated type auto tee-up machine with the simple structure of claim 1, wherein when the golf ball (1) is inserted and seated into the first ball chute (85), while the first ball chute (85) and the golf tee (52) ascend and the second ball chute (75) descends at a same time, the golf ball (1) is guided to the one-stage ball supports (90) and ascends and then passes through an upper portion of the one-stage ball supports (90) to reach between the one-stage ball supports (90) and the two-stage ball supports (100), sequentially, and while the first ball chute (85) and the golf tee (52) descend and the second ball chute (75) ascends at a same time, the golf ball (1) reaching between the one-stage ball supports (90) and the two-stage ball support (100) ascends while being guided to the two-stage ball supports (100) by the ascending second ball chute (75) and then passes through an upper portion of the two-stage ball supports (100) to be supplied to an upper end of the descending golf tee (52), and at a same time, the golf ball (1) is inserted and seated into the descending first ball chute (85), and sequentially, while the first ball chute (85) and the golf tee (52) ascend and the second ball chute (75) descends at the same time, the golf ball (1) supplied to the golf tee (52) is teed-up and the golf ball (1) seated on the first ball chute (85) is guided to the one-stage ball supports (90) and ascends, and then passes through the upper portion of the one-stage ball supports (90) to reach between the one-stage ball supports (90) and the two-stage ball supports (100), and when the teed-up golf tee (52) descends, the golf balls (1) is always supplied.

4. The ball supply integrated type auto tee-up machine with the simple structure of claim 1, wherein the guide rods (51, 71, and 81) are vertically provided through fixing brackets (17) fitted to bracket grooves (17*a*) recessed at upper and lower ends of the rear plate (13), respectively.

5. The ball supply integrated type auto tee-up machine with the simple structure of claim 1, wherein an upper cover (18) is provided at an upper end of the case (10) and ball exposure holes (18*a*) are formed in one side of the upper cover (18).

6. The ball supply integrated type auto tee-up machine with the simple structure of claim 1, wherein a slope (110) for supplying collected golf balls (1) to the first ball chute (85) by a natural gradient is provided adjacent to the ball inlet (12), a tensionable leaf spring (120) provided at a lower end of the slope (110) opens the slope (110) while being pressed downward by the first ball chute (85) when the first ball chute (85) reaches a lowest point so as to insert the golf ball (1), and the leaf spring (120) closes the slope (110) while being bent upward during ascending/descending of the first ball chute (85) so as to block insertion of the golf ball (1).

7. The ball supply integrated type auto tee-up machine with the simple structure of claim 1, wherein a slope (110) for supplying collected golf balls (1) to the first ball chute (85) by a natural gradient is provided adjacent to the ball inlet (12), a stopper device (130) is provided at a lower end of the slope 110 and the ball inlet 12, wherein a compression spring (133) is elastically provided in a stopper (132) fitted to an upper portion of a stopper guider (131) fixed to a bottom of the compression spring (133) to be movable up and down, a pressing protrusion (134) protruding from an outer surface of the stopper (132) opens the slope (110) while being pressed by a pusher (86) attached to a lower end of the first ball chute (85) when the first ball chute (85) reaches a lowest point so as to insert the golf ball (1), and the stopper (132) closes the slope (110) while moving upward during ascending/descending of the first ball chute (85) so as to block insertion of the golf ball (1).

8. A ball supply integrated type auto tee-up machine with a simple structure comprising:

a case (10) having an opened upper portion and having a ball inlet (12) formed at a side plate (11);

a tee-up motor (20) connected and provided to a rear surface of the case (10);

a driving belt (30) rotatably provided through a rear plate (13) below the case (10) and connected between one side of a driving shaft (15) and the tee-up motor (20);

a first driven belt (40) connected between another side of the driving shaft (15) and a first roller shaft (41) provided rotatably through an upper side of the rear plate (13);

a tee lift (50) provided to be able to ascend/descend over a linear motion (LM) guide (54) attached to the rear plate (13) between another side plate (11*a*) of the case (10) and the first driven belt (40) and guide rods (51) provided vertically, having one side coupled integrally to a lower side of the first driven belt (40), and having a golf tee (52) provided at an upper portion thereof;

a second driven belt (60) connected between a second roller shaft (61) and a driven shaft (63) provided through upper and lower sides of the rear plate (13) at a distance from the first driven belt (40), respectively;

a second lifting body (70) provided to be able to ascend/descend over a pair of guide rods (71) provided between the first driven belt (40) and the second driven belt (60) and having sides coupled integrally to upper sides of the first driven belt (40) and the second driven belt (60), respectively;

a second ball chute (75) attached to a front surface of the second lifting body (70) and inclined downward toward the golf tee (52);

a first lifting body (80) provided to be able to ascend/descend over a pair of guide rods (81) provided between the side plate (11) of the case (10) and the second driven belt (60) and having one side coupled integrally to a lower side of the second driven belt (60);

a first ball chute (85) attached to a front surface of the first lifting body (80) and inclined downward toward the golf tee (52);

a pair of one-stage ball supports (90) provided between the first ball chute (85) and the second ball chute (75); and a pair of two-stage ball supports (100) provided between the second ball chute (75) and the tee lift (50) and provided at a height higher than a height of the one-stage ball supports (90).

* * * * *